US009387595B2

(12) United States Patent
Ikoma

(10) Patent No.: US 9,387,595 B2
(45) Date of Patent: Jul. 12, 2016

(54) FOLDING KNIFE WITH LOCKING MECHANISM

(71) Applicant: GB II Corporation, Tualatin, OR (US)

(72) Inventor: Flavio Ikoma, Presidente Prudente (BR)

(73) Assignee: GB II Corporation, Tualatin, OR (US)

( * ) Notice: Subject to any disclaimer, the term of this patent is extended or adjusted under 35 U.S.C. 154(b) by 0 days.

(21) Appl. No.: 14/065,273

(22) Filed: Oct. 28, 2013

(65) Prior Publication Data

US 2014/0115900 A1 May 1, 2014

Related U.S. Application Data

(60) Provisional application No. 61/719,164, filed on Oct. 26, 2012.

(51) Int. Cl.
*B26B 1/04* (2006.01)

(52) U.S. Cl.
CPC ..... *B26B 1/042* (2013.01); *B26B 1/044* (2013.01); *B26B 1/04* (2013.01)

(58) Field of Classification Search
CPC ..... B26B 1/02; B26B 1/04; B26B 1/42; B26B 1/044; B26B 1/046
USPC ..... 30/161, 160, 155
See application file for complete search history.

(56) References Cited

U.S. PATENT DOCUMENTS 5,596,808 A * 1/1997 Lake ..... B26B 1/044 30/160
6,490,797 B1 12/2002 Lake et al.
7,305,768 B2 * 12/2007 Hinderer ..... B26B 1/044 30/155
7,437,822 B2 10/2008 Flagg et al.
7,536,788 B2 5/2009 VanHoy et al.
8,375,589 B2 2/2013 Bremer et al.
2006/0162168 A1 * 7/2006 Kao ..... B26B 1/048 30/161
2006/0260137 A1 * 11/2006 Flagg ..... B26B 1/044 30/160
2006/0260138 A1 * 11/2006 VanHoy ..... B26B 1/044 30/161
2009/0119926 A1 * 5/2009 Nenadic ..... B26B 1/04 30/161
2009/0183374 A1 * 7/2009 Kao ..... B26B 1/044 30/159
2009/0241348 A1 * 10/2009 Westerfield ..... B26B 1/044 30/161
2011/0010947 A1 * 1/2011 Freeman ..... B62B 1/048 30/159
2012/0198701 A1 * 8/2012 Lo ..... B26B 1/044 30/161
2012/0240412 A1 * 9/2012 Chen ..... B26B 1/044 30/161
2012/0291291 A1 * 11/2012 Lo ..... B26B 1/044 30/161
2013/0139324 A1 * 6/2013 Pelton ..... B26B 11/006 7/118
2013/0326884 A1 * 12/2013 Harvey ..... B62B 1/042 30/161

* cited by examiner

*Primary Examiner* — Stephen Choi
*Assistant Examiner* — Evan MacFarlane
(74) *Attorney, Agent, or Firm* — Klarquist Sparkman, LLP

(57) ABSTRACT

An exemplary folding knife has a handle including an inner liner portion and an outer panel. The inner liner portion includes a locking member that is operable to move between an unlocked position and a locked position. The folding knife includes a blade having a tang portion pivotally connected to the handle. The blade is operable to pivot relative to the handle about a pivot axis extending through the tang portion between a closed position and an open position. The tang portion engages the locking member when the blade is in the open position and the locking member is in the locked position. The folding knife also includes a lever member pivotally mounted to the locking member. The lever member is operable to block the locking member from moving from the locked position to the unlocked position when the blade is open.

18 Claims, 6 Drawing Sheets

FOLDING KNIFE WITH LOCKING MECHANISM

CROSS REFERENCE TO RELATED APPLICATION

This application claims the benefit of U.S. Provisional Patent Application No. 61/719,164, filed Oct. 26, 2012, which is incorporated herein by reference in its entirety.

FIELD

The present application concerns embodiments of a folding knife.

BACKGROUND

Folding knives having a liner lock type locking mechanism can include a rigid locking member configured to engage a tang portion of the blade when the blade is in the open position, thereby preventing the blade from folding closed during normal use. Some folding knives include a safety mechanism to prevent the locking member from inadvertently disengaging from the blade during use, although such safety mechanisms can be awkward to operate with one hand. Accordingly, improvements to folding knives are desirable.

SUMMARY

In one representative embodiment, a folding knife comprises a handle comprising an inner liner portion and an outer panel. The inner liner portion can include a locking member that is operable to move between an unlocked position and a locked position. The folding knife further comprises a blade having a tang portion pivotally connected to the handle. The blade is operable to pivot relative to the handle about a pivot axis extending through the tang portion between a closed position and an open position. The tang portion can also be configured to engage the locking member when the blade is in the open position and the locking member is in the locked position. The folding knife also comprises a lever member pivotally mounted to the locking member that is operable to pivot between a first position and a second position. The lever member can be configured to block the locking member from moving from the locked position to the unlocked position when the blade is in the open position.

In another representative embodiment, a method of using a folding knife comprises pressing a lever member with a thumb causing the lever member to move from a first position to a second position, the lever member being pivotally mounted to a locking member of a handle. With the thumb, moving the locking member from a locked position to an unlocked position relative to a tang portion of a blade of the folding knife while simultaneously pressing the lever member such that the lever member remains in the second position while moving the locking member, and folding the blade from an open position to a closed position.

In another representative embodiment, a folding knife comprises a handle and a blade having a tang portion pivotally connected to the handle. The blade can be operable to pivot relative to the handle about a pivot axis extending through the tang portion between a closed position and an open position. The folding knife can further include a locking means for releasably locking the blade in the open position, and a safety means mounted on the locking means for blocking movement of the locking means to an unlocked position in which pivoting movement of the blade is permitted.

DETAILED DESCRIPTION

This disclosure is set forth in the context of representative embodiments that are not intended to be limiting in any way.

As used herein, the singular forms "a," "an," and "the" include the plural forms unless the context clearly dictates otherwise. Additionally, the term "includes" means "comprises." Further, the term "coupled" encompasses mechanical as well as other practical ways of coupling or linking items together, and does not exclude the presence of intermediate elements between the coupled items.

The things and methods described herein should not be construed as being limiting in any way. Instead, this disclosure is directed toward all novel and non-obvious features and aspects of the various disclosed embodiments, alone and in various combinations and sub-combinations with one another. The disclosed things and methods are not limited to any specific aspect or feature or combinations thereof, nor do the disclosed things and methods require that any one or more specific advantages be present or problems be solved.

Although the operations of some of the disclosed methods are described in a particular, sequential order for convenient presentation, it should be understood that this manner of description encompasses rearrangement, unless a particular ordering is required by specific language set forth below. For example, operations described sequentially may in some cases be rearranged or performed concurrently. Moreover, for the sake of simplicity, the attached figures may not show the various ways in which the disclosed things and methods can be used in conjunction with other things and method. Additionally, the description sometimes uses terms like "produce"

and "provide" to describe the disclosed methods. These terms are high-level abstractions of the actual operations that are performed. The actual operations that correspond to these terms will vary depending on the particular implementation and are readily discernible by one of ordinary skill in the art.

In the following description, certain terms may be used such as "up," "down,", "upper," "lower," "horizontal," "vertical," "left," "right," and the like. These terms are used, where applicable, to provide some clarity of description when dealing with relative relationships. But, these terms are not intended to imply absolute relationships, positions, and/or orientations. For example, with respect to an object, an "upper" surface can become a "lower" surface simply by turning the object over. Nevertheless, it is still the same object.

Figure 1:
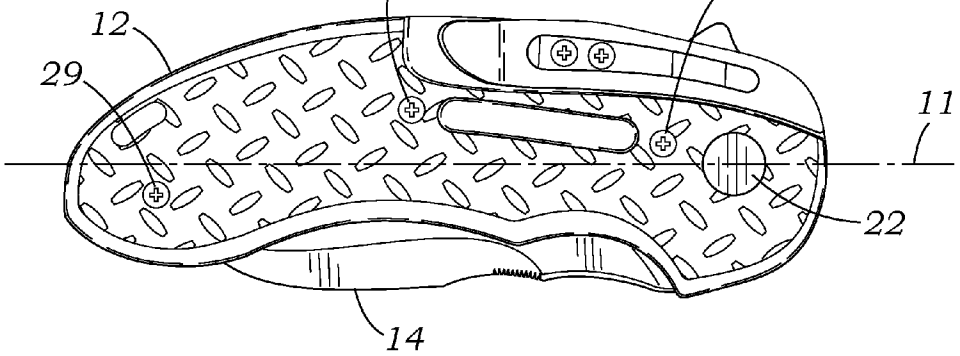
FIG. 1 is a side elevation view of a folding knife, according to one embodiment, with the blade shown in the closed position.
Figure 2:
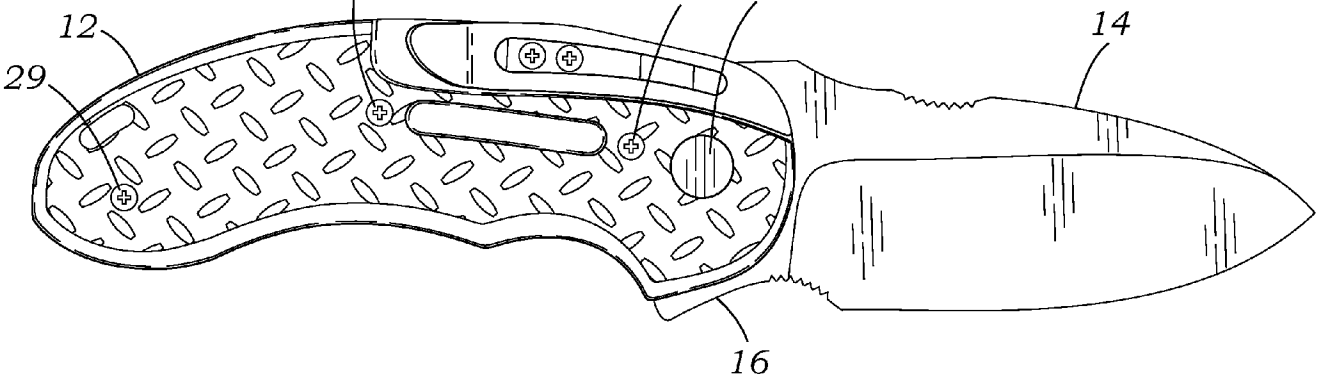
FIG. 2 is a side elevation view of the folding knife of FIG. 1, shown with the blade in the open position.

Referring to the figures, there is shown a folding knife 10, according to one embodiment. The knife 10 comprises a handle 12 and a knife blade 14 pivotally coupled to the handle at a tang portion 16 of the blade. The handle 12 of the knife 10 can comprise a first half 18 and a second half 20 (FIG. 3) with the blade 14 disposed therebetween. The blade 14 can be pivotable about a pivot axis between a closed, or folded, position as shown in FIG. 1 and an open position for use as shown in FIG. 2. The blade 14 can be pivotally coupled to the handle 12 by a pivot assembly comprising a pivot pin 22 extending through corresponding openings in the handle and the blade and a pivot screw (not shown) that extends through an opening in the opposite side of the handle and is tightened into an internally threaded opening in the pivot pin 22. The first handle portion 18 can comprise a first inner liner portion 19 and an outer side panel 24 (i.e., a first side panel) and the second handle portion 20 can comprise a second inner liner portion 21 and an outer side panel 26 (i.e., a second side panel). The first and second side panels 24 and 26 can be secured to the first and second liner portions 19 and 21 by the pivot pin 22 and the pivot screw, as well as by additional screws 29 located along the length of the first and second side panels 24 and 26, as shown in FIGS. 1 and 2.

Figure 4:
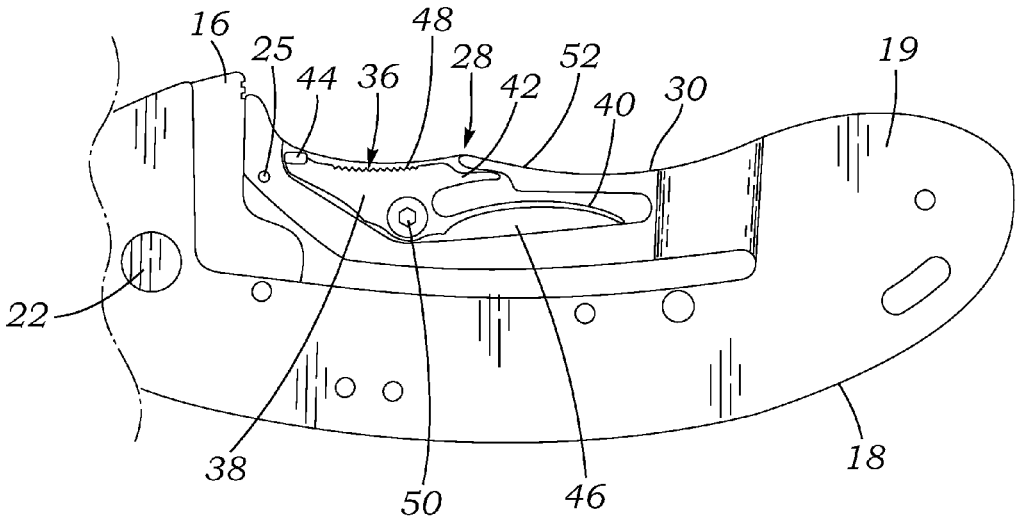
FIG. 4 is a side elevation view of the folding knife of FIG. 1, shown with the outer panel removed to reveal a liner lock type locking mechanism.

The knife 10 includes a liner lock type locking mechanism 28 for retaining the blade in the closed and/or open positions, as shown in FIG. 4. The locking mechanism 28 can include a locking member 30. In the embodiment shown, the locking member 30 can be configured as an upper locking bar, or leaf spring, that can be integrally formed in the first liner portion 19 of the handle 12. As used herein, the terms "integrally formed" and "unitary construction" refers to a construction that does not include any welds, fasteners, or other means for securing separately formed pieces of material to each other. For example, the locking member 30 is integrally formed with the first liner portion 19 of the handle 12 and does not require any welds, fasteners, or other means to secure the locking member to the handle. The locking mechanism 28 in the illustrated embodiment desirably is formed integrally with the liner portion 19 such that the liner portion 19 and the locking mechanism 28 have a unitary construction. However, in alternative embodiments, the locking member 30 can be separately formed and subsequently attached (e.g., by welds or fasteners) to the liner 19.

Figure 3:
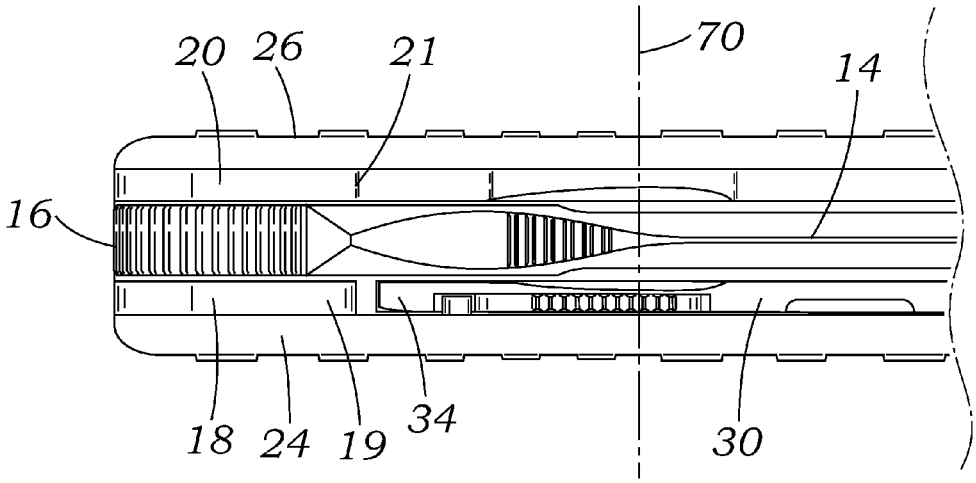
FIG. 3 is a bottom plan view of the folding knife of FIG. 1, shown with the blade in the closed position.
Figure 5:
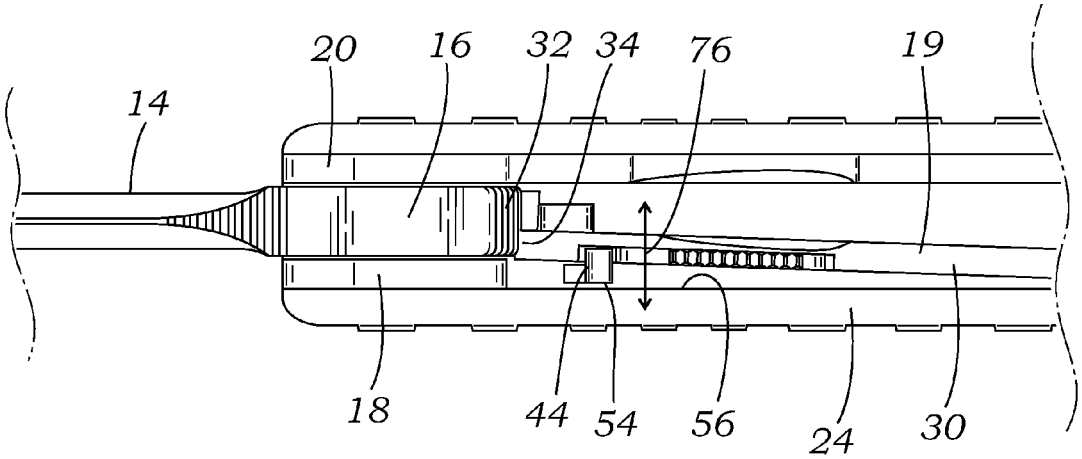
FIG. 5 is a bottom plan view of the folding knife of FIG. 1, shown with the blade in the open position.

Referring to FIGS. 3 and 5, the locking member 30 is movable between an unlocked and a locked position, respectively, as indicated by arrow 76 (FIG. 5). In the illustrated embodiment, the locking member 30 is formed such that it is resiliently biased against the side of the blade 14 when in the unlocked position, corresponding to the closed position of the blade (FIG. 3). In this manner, the locking member 30 functions as a "side-loaded" leaf spring in that pressure is applied to the side of the tang portion 16 by a free end portion 34 (also referred to as the locking end portion) of the locking member 30 in a direction perpendicular to the longitudinal edges of the first and second halves 18 and 20.

The locking member 30 can include a ball 25 which rests in a detent (not shown) in the tang portion 16 of the blade 14 when the blade is in the closed position. In this manner, the ball is biased into the detent by the spring-like action of the upper locking bar 30, keeping the blade 14 in the closed position against the weight of the blade. The blade may be moved to the open position by exerting sufficient pressure on the blade such that the spring-like action of the locking member 30 is overcome, thereby allowing the ball 25 to slip out of the detent. In embodiments where the ball and detent are not present, the biasing force of the locking member against the side of the blade is sufficient to keep the blade closed against its own weight.

Figure 6:
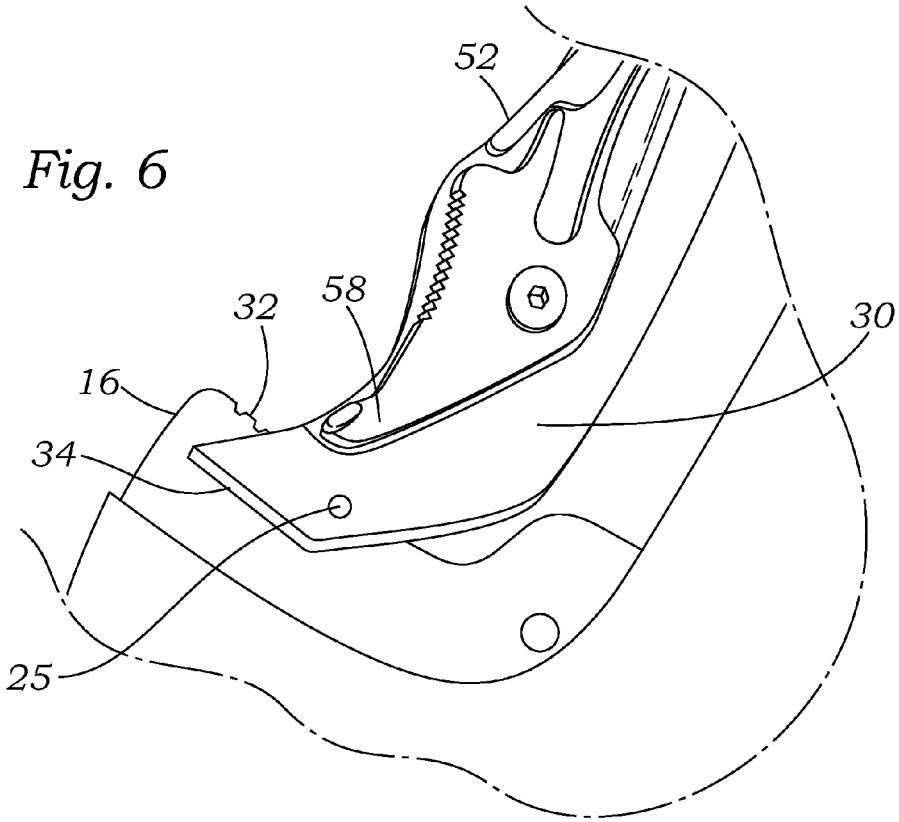
FIG. 6 is a partial side elevation view of the folding knife of FIG. 1, shown with the blade between the open and the closed positions and the outer panel removed for purposes of illustration.
Figure 7:
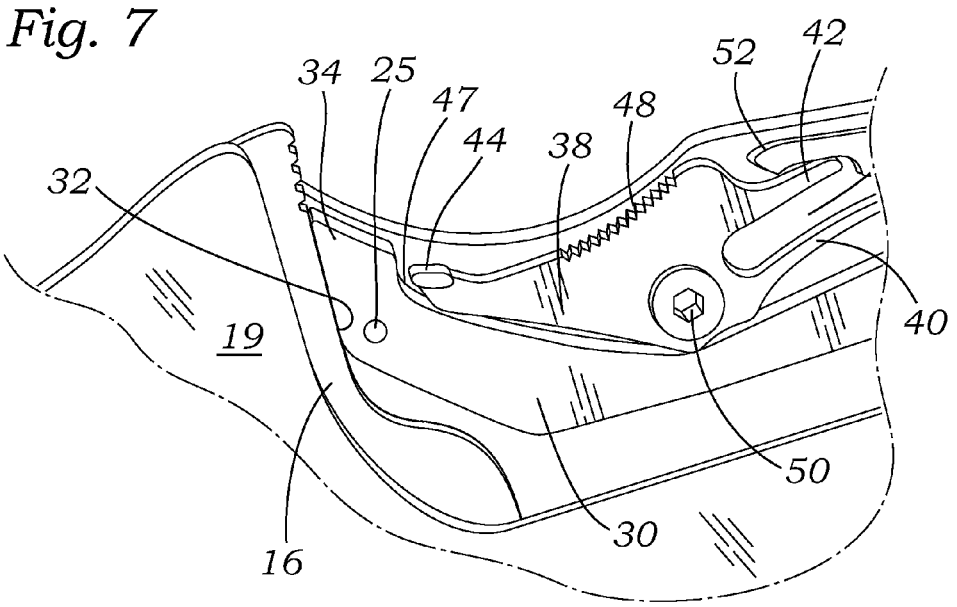
FIG. 7 is a partial side elevation view of the folding knife of FIG. 1, shown with the blade in the open and locked position and the outer panel removed for purposes of illustration.

The tang portion 16 of the blade 14 can comprise a notch 32 that engages a locking end portion 34 of the locking member 30 when the blade is moved to the open position, as shown in FIGS. 5-6. The spring-like action of the locking member 30 biases the locking end portion 34 into the notch 32, restraining movement of the blade 14 to the closed position, as shown in FIGS. 5 and 7.

Figure 8:
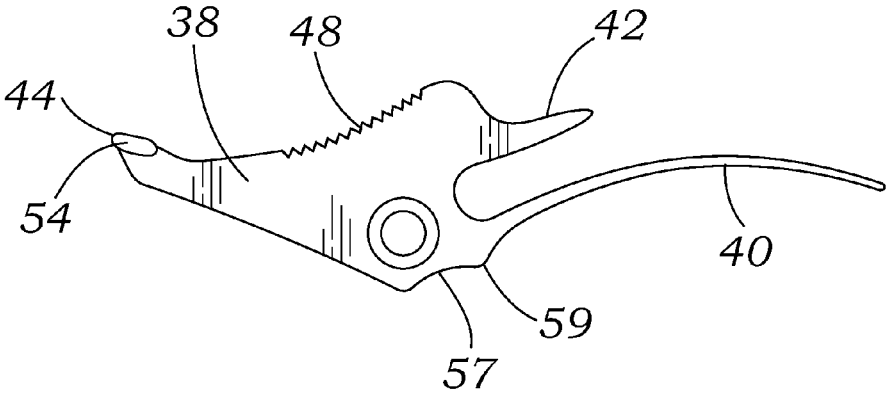
FIG. 8 is a side elevation view of a lever of a safety mechanism.

The locking member 30 can further comprise a lock safety mechanism generally shown at 36 (FIG. 4). In the embodiment shown, the lock safety mechanism comprises a lever member 38 having an integrally formed leaf spring (i.e., a spring portion) 40, catch portion 42, and a lateral protrusion or projection (i.e., a protruding portion) 44, as shown in FIGS. 4 and 8. In the illustrated embodiment, the protrusion 44 extends perpendicular to the lever member 38 substantially in a direction toward the first side panel 24. In the embodiment shown, the lever member 38 is disposed in a recessed portion 46 formed in the locking member 30. There can also be a gap 47 (FIG. 7) between the lever member 38 and the recessed portion 46 such that the lock safety mechanism will still function properly in case foreign matter (e.g., dirt, sand, etc.) gets between the lever member and the recessed portion. The lever member 38 can also comprise a textured grip region 48 to facilitate gripping by a thumb or finger of a user.

Figure 9:
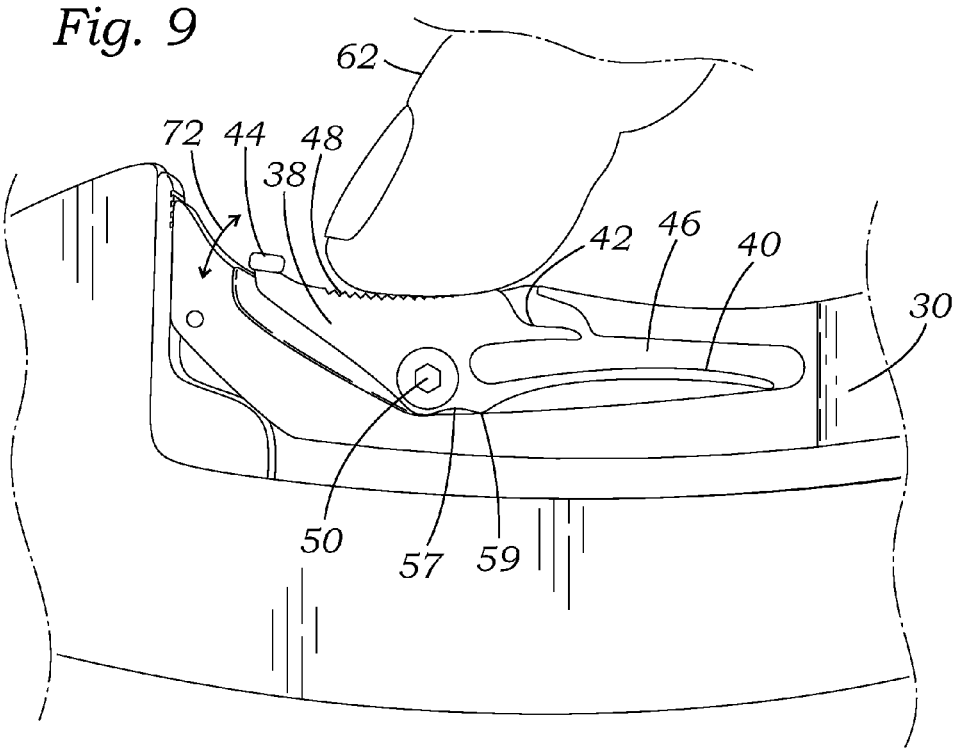
FIG. 9 is a partial side elevation view of the folding knife of FIG. 1, shown with the safety mechanism in a release position and the outer panel removed for purposes of illustration.

In the illustrated embodiment, the lever member 38 is pivotally coupled to the locking member 30 by a screw 50 that allows the lever member 38 to pivot in the direction of arrow 72 (FIG. 9) between a first, safety position, as shown in FIG. 4, and a second, release position, as shown in FIG. 9, about a pivot axis 70 perpendicular to the longitudinal axis 11 of the knife. When no manual pressure is applied to the lever member 38, the bias of the leaf spring 40 urges the lever member 38 to the first position such that the catch portion 42 bears against an upper extension portion 52 of the liner 19 (FIG. 4), so as to limit further counterclockwise rotation of the lever member.

In the first position, a side surface 54 of the protrusion 44 is oriented substantially adjacent to an interior surface 56 of the first side panel 24, as best shown in FIGS. 5 and 8. If a user attempts to move the locking member 30 from the locked to the unlocked position in a direction toward the side panel 24, the surface 54 of the protrusion contacts the interior surface 56 of the first side panel and prevents the locking member from moving into the unlocked position. Thus, the bias of the leaf spring 40 retains the lever member 38 in the safety position to protect against inadvertent closure of the blade until the user applies manual pressure to the lever member 38. In alternative embodiments, other techniques and/or mechanisms can be used to apply a biasing force to the lever member 38. For example, the safety mechanism can include a separate biasing element, such as a spring (e.g., a coil spring) or an elastic band, disposed in the recess 46 and configured to apply a biasing force to the lever member 38 that urges the lever member to the first position.

Figure 10:
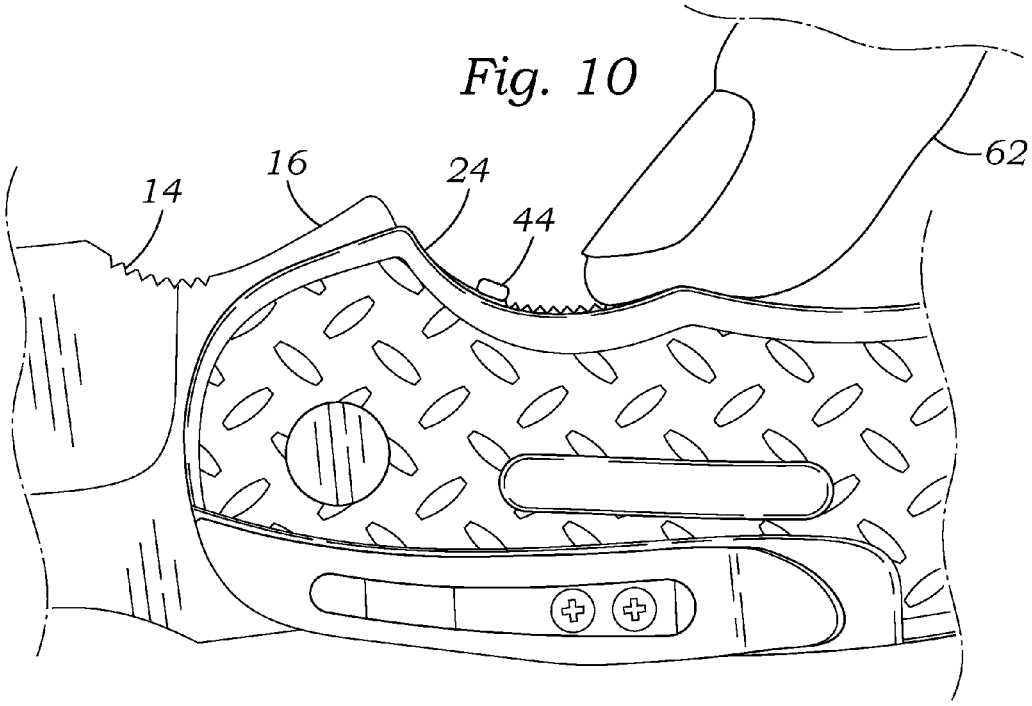
FIG. 10 is a partial side elevation view of the folding knife of FIG. 1 showing a protrusion of the safety mechanism in a release position substantially above an outer panel of the knife.

The lever member 38 and the locking member 30 can be jointly operable by a thumb 62 of a user, as shown in FIG. 9. To permit release of the locking member 30, the lever member 38 is moved to the second position by pivoting the lever member about the screw 50 by application of manual force to the grip region 48 with the thumb 62 (i.e., by pressing the grip region 48 of the lever member with the thumb 62). This causes the leaf spring 40 to compress, in turn causing the protrusion 44 to pivot to a position substantially above the first side panel, as shown in FIGS. 9-10. A recurve section 57 of the lever member 38 can limit rotation of the lever member in the clockwise direction by having a single point of contact 59 with the recess 46, as shown in FIGS. 8-9. While continuing to apply force to the lever member 38 such that the protrusion 44 remains pivoted substantially above the first side panel, the locking member 30 may be moved to the unlocked position with the thumb 62, and the blade may be folded closed. Thus, it can be seen that the safety mechanism and the liner lock can be easily operated with one hand. Of course, other fingers of the same hand or the opposite hand can be used to operate the safety mechanism and/or the liner lock if desired.

Figure 11:
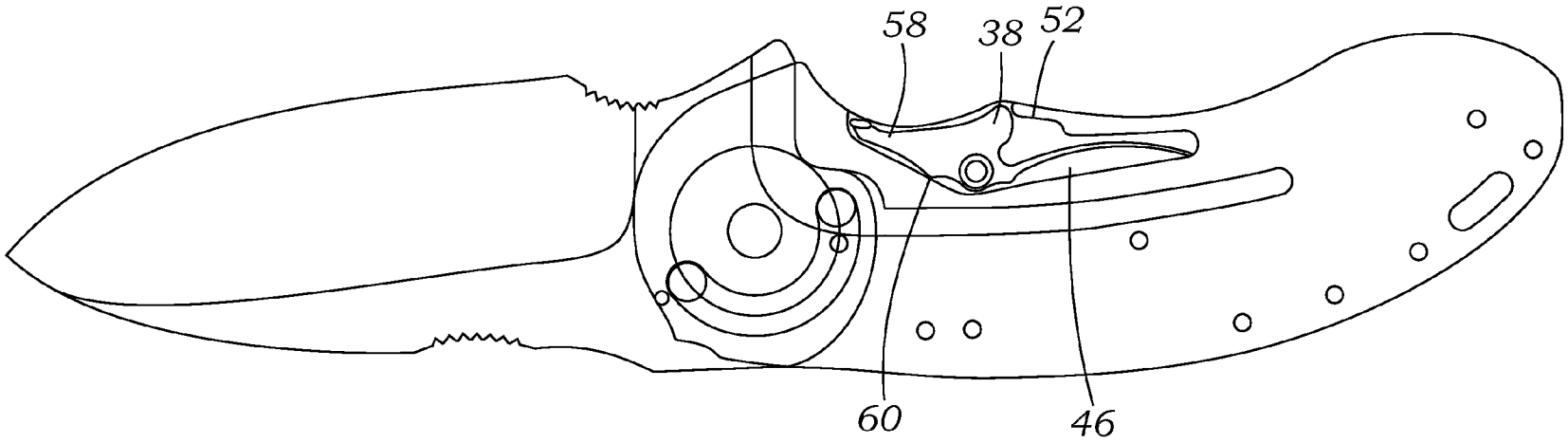
FIG. 11 is a side elevation view of a folding knife, according to another embodiment.

In an alternative embodiment, shown in FIG. 11, counterclockwise rotation of the lever member 38 past the safety position is limited by a free end portion 58 of the lever member having a single point of contact 60 with the recessed portion 46. The single point of contact 60 operates to limit the counterclockwise rotation of the lever member by contacting the adjacent inner surface of the recessed portion 46, in which case catch portion 42 can be optional.

In view of the many possible embodiments to which the principles of the disclosed invention may be applied, it should be recognized that the illustrated embodiments are only preferred examples of the invention and should not be taken as limiting the scope of the invention.

I claim:

1. A folding knife, comprising:

a handle comprising first and second inner liner portions and first and second outer panels secured to respective outer surfaces of the inner liner portions, the first inner liner portion including a locking member operable to move between an unlocked position and a locked position;

a blade having a tang portion pivotally connected to the handle between the first and second inner liner portions, the blade being operable to pivot relative to the handle about a pivot axis extending through the tang portion between a closed position and an open position, the tang portion being configured to engage the locking member when the blade is in the open position and the locking member is in the locked position; and a lever member pivotally mounted to the locking member, the lever member being operable to pivot between a first position and a second position, the lever member including a blocking portion, a spring portion opposite the blocking portion to bias the lever member to the first position, and a grip portion between the blocking portion and the spring portion;

wherein the blocking portion of the lever member is configured to contact an inner surface of the first outer panel opposite the outer surface of the first inner liner portion of the handle to block the locking member from moving from the locked position to the unlocked position when the blade is in the open position and the lever member is in the first position; and wherein when the lever member is pivoted to the second position, the blocking portion is located outside the handle of the knife.

2. The folding knife of claim 1, wherein the blocking portion is a laterally extending protruding portion configured to contact the inner surface of the first outer panel of the handle when the blade is in the open position and the lever member is in the first position.

3. The folding knife of claim 1, wherein:

the locking member further comprises a recessed portion; and the lever member is pivotally mounted in the recessed portion.

4. The folding knife of claim 3, wherein:

rotational motion of the lever member is limited by a free end portion of the lever member having a point of contact with a surface of the recessed portion.

5. The folding knife of claim 1, wherein the spring portion is a curved spring portion integrally formed with the lever member.

6. The folding knife of claim 1, wherein the locking member is resiliently biased against a side of the blade when the blade is in the closed position.

7. The folding knife of claim 1, wherein the lever member and the locking member are configured to be jointly operable by a user's thumb.

8. The folding knife of claim 1, wherein rotational motion of the lever member is limited by a catch portion of the lever member having a point of contact with an extension portion of the first inner liner portion.

9. The folding knife of claim 8, wherein the catch portion is located between the blocking portion and the spring portion.

10. The folding knife of claim 1, wherein the lever member is coupled to the locking member by a pin member and is pivotable about the pin member without translating linearly along the locking member.

11. A method of using a folding knife, comprising:

pressing a grip portion of a lever member with a thumb causing the lever member to pivot from a first position to a second position, the lever member being pivotally mounted to a locking member of a first inner liner portion of a handle comprising the first inner liner portion, a second inner liner portion, and first and second outer panels secured to respective outer surfaces of the inner liner portions, the knife further comprising a blade having a tang portion pivotally connected to the handle between the first and second inner liner portions, the blade being operable to pivot relative to the handle about a pivot axis extending through the tang portion between a closed position and an open position, the tang portion being configured to engage the locking member when the blade is in the open position and the locking member is in a locked position, the lever member including a blocking portion configured to contact an inner surface of the first outer panel opposite the outer surface of the first inner liner portion when the blade is in the open position and the lever member is in the first position to block the locking member from being moved from the locked position to an unlocked position, the blocking portion being located outside the handle when the lever member is pivoted to the second position, the lever member further including a spring portion opposite the blocking portion to bias the lever member to the first position, the grip portion being between the blocking portion and the spring portion;

with the thumb, moving the locking member from the locked position to the unlocked position relative to the tang portion of the blade while simultaneously pressing the lever member such that the lever member remains in the second position while moving the locking member; and folding the blade from the open position to the closed position.

12. The method of claim 11, wherein pressing the grip portion to pivot the lever member to the second position causes the blocking portion of the lever member to pivot past an edge of the inner surface of the first outer panel of the handle in a direction perpendicular to a longitudinal axis of the handle and perpendicular to the pivot axis of the blade.

13. The method of claim 11, wherein pressing the lever member further comprises compressing the spring portion of the lever member.

14. The method of claim 11, wherein moving the locking member further comprises moving the locking member from the locked position to the unlocked position in a direction perpendicular to a longitudinal axis of the knife.

15. A folding knife, comprising:

a handle including first and second inner liner portions and first and second outer panels secured to respective outer surfaces of the inner liner portions, the first inner liner portion including a locking member operable to move between an unlocked position and a locked position;

a blade having a tang portion pivotally connected to the handle between the first and second inner liner portions, the blade being operable to pivot relative to the handle about a pivot axis extending through the tang portion between a closed position and an open position, the locking member being operable to engage the tang portion when the blade is in the open position and the locking member is in the locked position; and a lever member pivotally mounted to the locking member, the lever member including a laterally extending protruding portion and being pivotable between a first position and a second position with rotational motion of the lever member;

wherein the lever member is configured such that when the locking member is in the locked position and the lever member is in the first position, the protruding portion is located within a longitudinal edge portion of the first outer panel such that the protruding portion contacts an inner surface of the first outer panel opposite the outer surface of the first inner liner portion to block the locking member from moving to the unlocked position and, when the lever member is pivoted to the second position, the protruding portion is located beyond the longitudinal edge portion of the first outer panel in a direction perpendicular to a longitudinal axis of the handle and perpendicular to the pivot axis of the blade such that at least the protruding portion is located outside the handle of the knife.

16. The folding knife of claim 15, wherein:

the locking member further comprises a recessed portion; and the lever member is pivotally mounted in the recessed portion.

17. The folding knife of claim 15, wherein the locking member and the lever member are configured to be jointly operable by a user's thumb.

18. The folding knife of claim 15, wherein the lever member further includes a curved spring portion integrally formed with the lever member to bias the lever member to the first position.

* * * * *